United States Patent [19]

Holmes

[11] Patent Number: 4,762,199

[45] Date of Patent: Aug. 9, 1988

[54] AERIAL LIFT INCLUDING FIBER OPTICS BOOM CONTROL

[75] Inventor: William K. Holmes, Delafield, Wis.

[73] Assignee: Hi-Ranger, Inc., Waukesha, Wis.

[21] Appl. No.: 935,526

[22] Filed: Nov. 26, 1986

Related U.S. Application Data

[63] Continuation-in-part of Ser. No. 744,969, Jun. 1, 1985, abandoned.

[51] Int. Cl.[4] ..... B66F 11/04

[52] U.S. Cl. ..... 182/2; 182/148

[58] Field of Search ..... 182/2, 63, 18, 19, 62.5, 182/141, 148; 455/614, 617

[56] References Cited

U.S. PATENT DOCUMENTS

| | | | |
|---|---|---|---|
| 2,836,467 | 5/1958 | Myers | 182/2 |
| 3,136,385 | 6/1964 | Gitel | 182/2 |
| 3,516,514 | 6/1970 | Malloy et al. | 182/2 X |
| 3,709,322 | 1/1973 | Mitchell | 182/148 X |
| 3,757,895 | 9/1973 | Knutson | 182/2 X |
| 3,809,182 | 5/1974 | Wilson | 182/2 X |
| 3,844,378 | 10/1974 | Balog | 182/2 X |
| 4,044,856 | 8/1977 | Stevenson | 182/2 |
| 4,084,619 | 4/1978 | Johnson | 182/2 X |
| 4,113,054 | 9/1978 | Myers | 182/2 |
| 4,520,894 | 6/1985 | Hensler | 182/2 |

OTHER PUBLICATIONS

Electronic Review, 10-5-79, vol 52 pp. 39,40 John Gosch.

*Primary Examiner*—Alvin C. Chin-Shue

*Attorney, Agent, or Firm*—Michael, Best & Friedrich

[57] ABSTRACT

A hydraulically operated aerial lift with an improved bucket position control device supported by the bucket. Control valves for controlling operation of the aerial lift hydraulics are mounted on the stationary frame of the lift and the bucket position control device supported by the bucket is operably connected to the control valves by an optic fiber.

30 Claims, 5 Drawing Sheets

AERIAL LIFT INCLUDING FIBER OPTICS BOOM CONTROL

This is a continuation-in-part of patent application, Ser. No. 744,969 filed June 1, 1985, now abandoned.

FIELD OF THE INVENTION

The present invention is directed to articulated booms and to hydraulic control mechanisms for operating articulated booms.

BACKGROUND PRIOR ART

Mobile aerial towers or lifts conventionally comprise a pair of elongated booms which are articulated or pivotally joined together. The lower end of one of the members is pivotally mounted upon a mobile platform while the opposite end of the other boom pivotally carries a bucket in which the operator rides. The platform is supported for rotation about a vertical axis to thereby provide for lateral swinging movement of the bucket, and the booms pivot about horizontal pivot axes to facilitate vertical movement of the bucket as well as fore and aft movement of the bucket. Three hydraulic or other suitable motors are provided for effecting three different movements of the articulated booms. One hydraulic motor is operative to control rotary motion of the platform about the vertical axis of rotation. Another of the hydraulic motors comprises a cylinder operative to swing the lower boom about its pivotal connection with the platform. The third hydraulic motor comprises a hydraulic cylinder which functions to cause pivotal movement of the upper boom with respect to the lower boom.

Hydraulic control valves are used to control the operation of the three hydraulic motors to thereby effect movement of the booms. The prior art structures have also included a hydraulic control system mounted with the bucket and connected to the control valves to permit the operator in the bucket to control operation of the boom. A preferred control mechanism is illustrated in the Myers U.S. Pat. No. 3,133,471 issued May 19, 1964. The control mechanism of that patent provides a plurality of hydraulic control valves operably connected by a plurality of pairs of hydraulic lines extending along the length of the boom to the valves controlling the hydraulic motors. One of the advantages of the arrangement provided by the Myers patent is that it permits the operator to precisely control movement of the articulated booms. Movement of the booms either horizontally or vertically tends to cause the operator's weight to be shifted. The control arrangement of Myers prevents feedback by providing controlled movement of the control handle such that the operator's momentum during movement of the bucket does not cause the operator to move the control handle too far thereby causing overreaction or overtravel of the bucket.

One of the disadvantages or drawbacks of the prior art constructions is that each hydraulic control function of the control valve requires a pair of hydraulic control lines extending the full length of the booms and connected to the valves. Accordingly, it is common to have at least six hydraulic lines extending the length of the boom.

Another feature of the prior art control arrangements is that the functions which can be accomplished by the control arrangement at the bucket are limited by the complexity of those systems having a pair of hydraulic fluid lines extending the full length of the boom for each control function. Other arrangements have a captive air system for each function, such air systems being very cumbersome and inaccurate due to the inherent compressive nature of air.

SUMMARY OF THE INVENTION

The present invention provides an improved hydraulically operated aerial lift with improved means for controlling hydraulic valves which in turn control the movement of the articulated boom. The improved means for controlling the articulated boom includes an electronic control means located at the bucket and operably connected to the valves causing operation of the hydraulic motors controlling the position of the boom. The electronic control means can include a single optic fiber operably connecting the control means at the bucket to the hydraulic control valves mounted on the truck supporting the articulated boom.

One of the principal advantages of the invention is that a greater number of functions can be accomplished using the controls at the bucket than can be accomplished by prior art constructions. By providing electronic controls and a fiber optic connection, additional electrical control apparatus can be mounted at the bucket. For example, the electrical control apparatus can include an engine ignition switch for operating the truck engine, and a throttle control. Apparatus can also be provided for a voice link from the bucket to the 2-way radio of the truck. The electronic control apparatus can also include means for operating a spotlight mounted on the truck from the bucket.

Another advantage is that the plurality of hydraulic lines providing connection between the boom mounted control and the valves can be replaced by a single optic fiber. Accordingly, the apparatus of the invention avoids hydraulic fluid leaks and maintenance to bleed air from the hydraulic fluid lines.

The provision of a single optic fiber connecting the control handle to the control valves also permits the control valves to be supported by the truck frame rather than above the aerial tower point of rotation. If the hydraulic control valves are supported by the truck frame, the hydraulic connections at the aerial tower swivel can be substantially less complicated than in the prior art constructions, and no electrical connection is required between a fixed portion of the swivel and a rotating portion of the swivel.

Another advantage of the invention is that while a larger number of functions can be provided using the control means embodying the invention, the control handle is operable in the same manner as the prior art hydraulic control apparatus and includes those advantages of the prior art controls which permit the operator to easily and accurately control movement of the bucket.

More specifically, the invention includes an aerial lift having a frame, a support structure supported by the frame, a boom, and means for pivotally joining the boom to the support structure, the upper end of the boom supporting a platform for use in supporting a workman. A first hydraulic cylinder is connected to the boom for causing movement of the boom. Means are also provided for controlling operation of the hydraulic fluid cylinder, this means including valve means, a manually operable control means supported by the bucket and adapted to be manipulated by the operator to provide for controlled movement of the bucket, and an optic fiber means operably connecting the manually operable control means to the valve means.

In a preferred form of the invention the valve means is supported by the frame of the truck supporting the aerial lift.

In a preferred embodiment of the invention the control means includes a control handle adapted to be manipulated by the operator in the bucket, and means are also provided for supporting the handle for rotation around its longitudinal axis, for pivotal movement about a pivot axis transverse to the longitudinal axis and extending generally through the handle, and for reciprocal movement generally in the direction of the longitudinal axis.

One of the principal features of the invention is the provision of a manually operable control which includes means for producing a first proportional electrical signal when the control handle is rotated about its longitudinal axis, means for producing a second proportional electrical signal when the control handle is pivoted about a pivot axis transverse to the longitudinal axis, and means for producing a third proportional electrical signal when the control handle is moved in the direction of its longitudinal axis.

In a preferred form of the invention the means for producing the first proportional electrical signal includes a first linearly movable member and means for producing an electrical signal proportionate to the length of movement of the linearly movable member. The means for producing the second proportional electrical signal similarly includes a second linearly movable member and means for producing an electrical signal proportionate to the length of movement of the second linearly movable member. The means for producing the third proportional electrical signal also includes a third linearly movable member and means for producing an electrical signal proportionate to the length of movement of the third linearly movable member.

Another of the principal features of the invention is the provision of optic fiber means which includes means for receiving the electrical signals from the means for producing electrical signals and for converting the electrical signals to signals which can be conveyed by an optic fiber, and means located adjacent the lower end of the articulated boom for converting the signal conveyed by the optic fiber to an electrical signal for thereby controlling the electro-hydraulic proportionate control valves and other on-off functions.

Another principal feature of the invention is the provision of optic fiber means including a first optic fiber adapted to be supported by the boom and having one end adjacent the bucket and an opposite end adjacent the frame. A means for receiving a fiber optic signal is supported adjacent the lower end of the first optic fiber. Swivel means are provided for supporting the means for receiving the fiber optic signal and the adjacent end of the first optic fiber such that an optic signal conveyed by the first optic fiber will be transmitted to the means for receiving the fiber optic signal and such that the first optic fiber is rotatable with respect to the means fo receiving the fiber optic signal.

Various other features and advantages of the invention will be apparent by reference to the following description of a preferred embodiment, to the drawings and to the claims.

Figure 1:
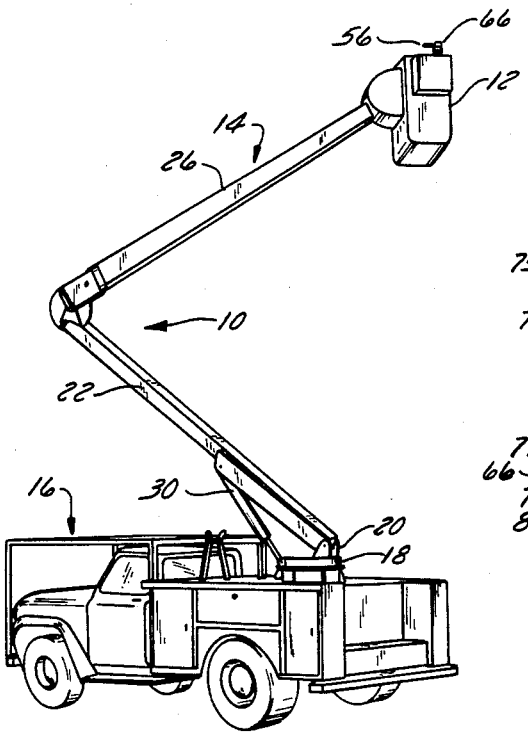
FIG. 1 is a perspective view of a truck mounted aerial lift employing the present invention.

Before describing a preferred embodiment of the invention in detail, it is to be understood that the invention is not limited to the details of construction and to the arrangement of components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF A PREFERRED EMBODIMENT

Figure 5:
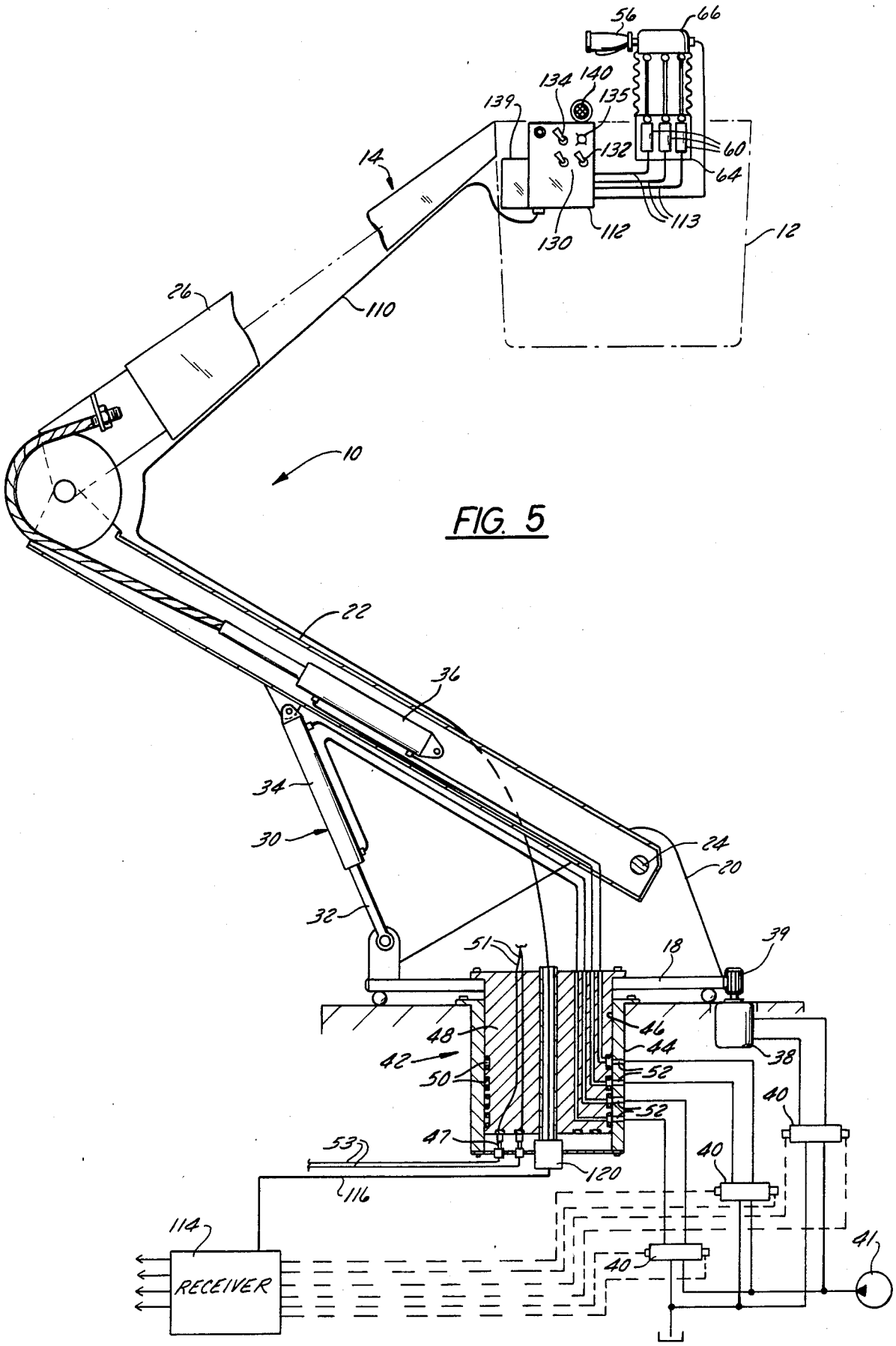
FIG. 5 is an enlarged partial elevation view of the boom shown in FIG. 1 and showing the fiber optic control mechanism used to operate the aerial lift illustrated in FIG. 1.

Illustrated in FIG. 1 is a truck mounted aerial lift 10 of the type adapted to carry one or more workmen in a bucket or basket 12 supported on the vertically movable end of an articulated boom 14. More specifically the apparatus includes a truck 16 having mounted on the rear end thereof a conventional turntable 18 having an upstanding support or frame 20 thereon. The frame or support 20 is supported by the turntable 18 for rotation about a vertical axis. A lower elongated boom 22 is pivotally connected to the support 20 by a horizontal shaft 24 (FIG. 5). An elongated upper boom 26 is pivotally connected to the opposite end of the lower boom 22 in a conventional manner and such that the two booms 22 and 26 are pivotable with respect to one another about a horizontal pivot axis. The extending end of the upper boom 26 supports the operator's platform or bucket 12. The bucket 12 is pivotally joined to the free end of the upwardly extending end of the boom 26 in a conventional manner and such that the floor of the bucket 12 will remain horizontal during extension of the upper end of the upper boom 26.

When the aerial lift 10 is completely folded, the booms 22 and 26 are supported adjacent to the truck 16 and extend substantially horizontally. The bucket 12 is positioned adjacent the truck bed such that personnel can easily enter and depart therefrom.

Means are also provided for causing extension of the articulated booms 22 and 26 to thereby cause vertical movement of the bucket 12 and the operator. In the illustrated arrangement this means is conventional and includes a first hydraulic cylinder 30 having one end 32 pivotally supported by the upstanding support or frame 20 and an opposite end 34 pivotally connected to the lower boom 22.

A second hydraulic cylinder 36 is connected in a conventional manner between the upper end of the lower boom 22 and the upper boom 26. The cylinders 30 and 36 are positioned such that extension of the cylinder 30 and retraction of cylinder 36 will cause selective vertical movement and extension of the bucket 12.

Means are also provided for causing pivotal movement of the turntable 18 and the upstanding support 20 about the vertical axis to thereby provide for horizontal positioning of the bucket 12. While various hydraulically operated means could be provided for causing such rotation, in the particular embodiment illustrated in the drawings a conventional hydraulic motor 38 is provided. The hydraulic motor drives a gear 39 engaging gear teeth on the periphery of the turntable 18.

Means are also provided for controlling operation of the hydraulic cylinders 30 and 36 to thereby cause vertical extension of the boom and for controlling operation of the hydraulic motor 38 providing for rotation of the support 20. In the illustrated construction this means includes three conventional electro-hydraulic proportionate control valves 40. In the illustrated arrangement one of the three hydraulic control valves 40 controls the hydraulic cylinder 30, one controls the hydraulic cylinder 36, and one controls the rotary hydraulic motor 38. While the hydraulic control valves 40 could be supported in other ways, in the illustrated construction they are fixedly supported by the truck frame. The truck frame also supports a hydraulic fluid pump 41 driven by the truck engine, and the hydraulic control valves 40 are connected to the cylinders 30 and 36 through a hydraulic swivel 42. While the hydraulic swivel 42 could have alternative constructions, in the illustrated construction the truck frame supports a swivel body 44 having a central cylindrical bore 46. The central bore 46 houses a rotatable spool 48 supported in the central bore 46 for rotation about a vertical axis with the support structure 20. The central rotatable spool 48 includes a plurality of spaced apart grooves 50, and the grooves 50 communicate with fluid ports 52 in the swivel body 44. The hydraulic fluid ports of the valves 40 can thus be operably connected through the swivel 42 to the hydraulic cylinders 30 and 36.

The swivel 42 can also include means for providing electrical connection between electrical wires 53 supported by the truck frame and wires 51 which may be connected to accessories above the swivel. In the illustrated arrangement, the wires 51 are connected to electrically conductive rings 45 supported by the bottom of the rotatable spool 48, and brushes or contacts 47, fixedly supported by the truck frame, are electrically connected to the wires 53 and provide an electrical connection between the rings 45 and the wires 53.

Means are also provided for permitting the operator in the bucket to control the operation of the three hydraulic control valves 40 and for thereby controlling operation of the hydraulic cylinders 30 and 32 and the rotary hydraulic motor 38. This means includes a control handle 56 supported by the bucket 12 in a position wherein it is readily available to the operator. While the control handle 56 could be mounted in various positions so as to be convenient to the operator, in the illustrated arrangement it is positioned at one side of the bucket 12.

The control handle 56 (best shown in FIG. 2) includes a longitudinal axis and is supported for pivotable or twisting movement about this longitudinal axis. Means are connected to the control handle 56 for causing swinging movement of the articulated boom 14 about the central vertical pivot axis of turntable 18 in response to such twisting movement of the control handle 56. More particularly, when the control handle 56 is twisted in a first direction, the articulated boom 14 will swing or pivot in one direction, and when the control handle is twisted in the opposite direction, the articulated boom 14 will swing or pivot in an opposite rotational direction.

Means are also provided for supporting the control handle 56 for movement generally up and down wherein the control handle 56 causes vertical movement of the bucket 12. When the control handle 56 is pulled upwardly, the bucket 12 moves upwardly, and when the control handle 56 is pushed downwardly, the bucket will move downwardly.

The means for supporting the control handle 56 also supports the control handle 56 for generally linear reciprocal fore and aft movement with respect to the longitudinal axis of the control handle 56. The control handle 56 is supported such that it can be pushed forwardly to cause forward movement of the bucket 12, and the control handle is pulled rearwardly to cause generally horizontal retraction of the bucket.

Figure 8:
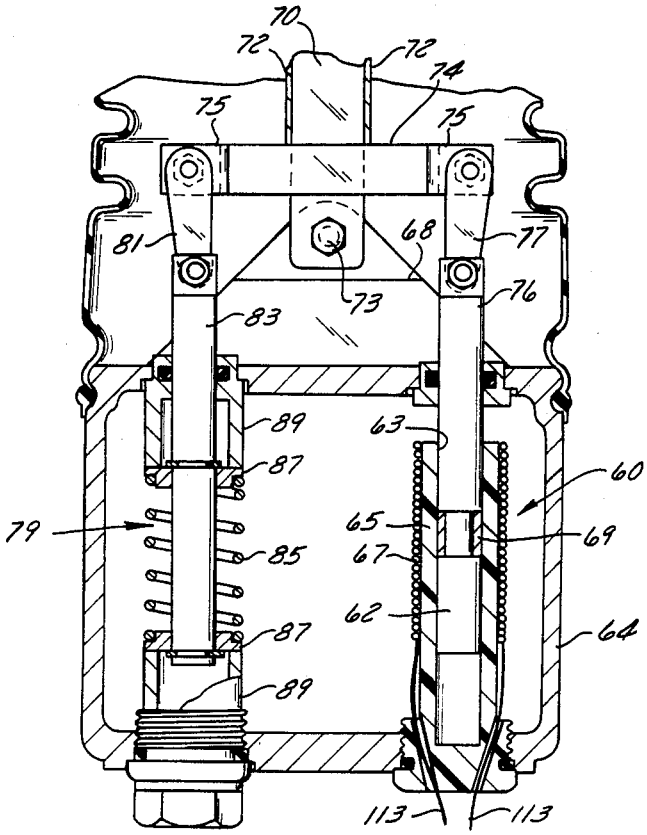
FIG. 8 is an enlarged partial view of apparatus shown in FIG. 2 and with portions broken away.

The means for permitting the operator to control the operation of the three electro-hydraulic proportionate control valves 40 includes three linear variable displacement transducers 60 shown more specifically in FIGS. 2 and 8 and electrically connected, in a manner which will be described in greater detail hereinafter to respective ones of the electro-hydraulic proportional control valves 40. Each of the linear variable displacement transducers 60 has a conventional construction and includes a central spool 62 (FIG. 8) supported for linear reciprocal movement in a bore 63 of a supporting sleeve 65. The supporting sleeve 65 is comprised of an electrically insulating material, and in one form of the invention can be conveniently comprised of plastic. The sleeve 65 is surrounded by electrical windings 67. The central spool 62 carries a steel or iron ring 69 for reciprocal slideable movement in the bore 63. As is well known in the art, reciprocal movement of the central spool 62 and the ring 69 causes the linear variable displacement transducer 60 housing the spool 62 to control an electrical signal. This signal is transmitted through the fiber optic system and then to the appropriate electro-hydraulic control valve 40 to cause operation of that control valve 40.

Referring more particularly to the apparatus for supporting the control handle 56, in the illustrated construction it includes a control structure frame 64 which is adapted to be fixed to the bucket or basket 12 in a position wherein the control handle 56 is supported by the control structure frame 64 such that the control handle 56 is conveniently positioned for an operator in the bucket 12. In the illustrated construction the apparatus also includes a metal cup-shaped cap 66 which is pivotally supported by a pair of upwardly extending spaced apart lugs 68 and by a pair of spaced apart, parallel and upwardly extending links 70 preferably made of rigid metal bar stock. The upper ends of these links 70 are pivotally secured by bolts 71 to opposite sides of the metal cap 66, and the lower ends of the bars or links 70 are pivotally joined by bolts 73 to the supporting lugs 68. Two Plates 72 are secured to the two links 70 and are positioned o opposite sides of the links 70 to provide rigidity to the links and to insure pivotal movement of the links 70 as a unit.

A lever 74 is fixedly secured to the links 70 adjacent the location where the links 70 are pivotally joined to the upstanding lugs 68, and the lever 74 includes opposite ends 75 projecting outwardly from the links 70. One of these opposite ends 75 of the lever 74 is pivotally connected by a link 77 to an upper end 76 of the linearly reciprocable central spool 62 of one of the linear variable displacement transducers 60. When the links 70 are caused to pivot about the pivot axis where the lower ends of the links 70 are joined to the upwardly extending lugs 68, the lever arm 74 will cause vertical movement of the central spool 62 of one of the linear variable displacement transducers 60. It will be seen that such pivotal movement of the lever arm 74 is caused by moving the control handle 56 forwardly and rearwardly with respect to the support frame 64 of the control. Such pivotal movement of the links 70 and fore and aft movement of the control handle 56 is resisted by a compression spring assembly 79 connected to the opposite end 75 of the lever arm 74. While various other means could be provided for resiliently resisting movement of the control handle 56 and biasing it toward a neutral position, in the particular construction of the invention illustrated in FIG. 8, the compression spring assembly 79 includes a central shaft 83 having an upper end connected by a link 81 to an end 75 of the lever arm 74. Means are also provided for resiliently biasing the central shaft 83 toward a neutral position. This means includes a compression spring 85. A pair of collars 87 surround the central shaft 83 and are fixed to the shaft 83. The collars 87 engage the opposite ends of the coil spring 85 and the collars 87 and the spring 85 are housed between a pair of support members 89 such that vertical movement of the central shaft 83 is resisted by the coil spring 85. The support members 89 are fixed to the housing 64 and include aligned bores for supporting the opposite ends of the central shaft for linear reciprocal movement.

Figure 4:
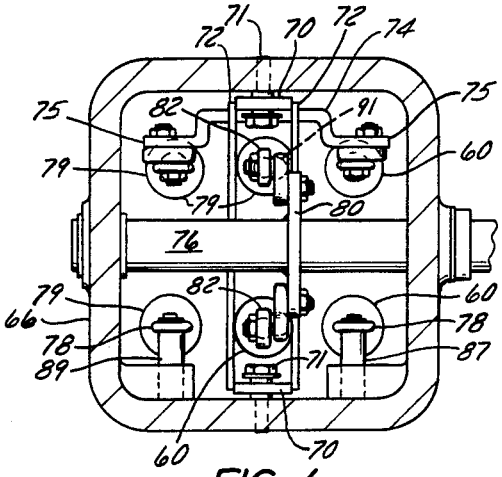
FIG. 4 is a cross-section view taken along line 4—4 in FIG. 2.
Figure 3:
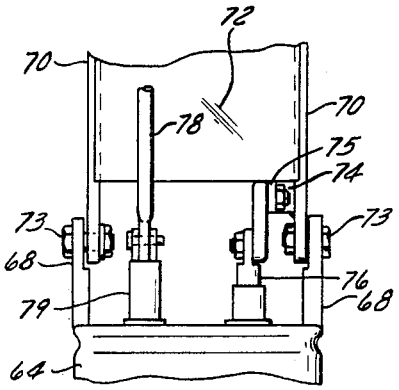
FIG. 3 is a view taken along line 3—3 in FIG. 2 and with portions broken away.

Means are also provided for causing vertical reciprocal movement of the central spool 62 of a second one of the linear variable displacement transducers 60 in response to up and down movement of the control handle 56. As illustrated in FIGS. 2 and 4, the control handle 56 is supported for movement with the cap 66, and the cap 66 is pivotally supported by the upper ends of the links 70 for pivotal movement about the axes of the pivot pins or bolts 71 such that the control handle 56 is movable up and down. The upper ends of the links 70 support the metal cap 66 such that it is supported for pivotal movement about a horizontal axis extending through the upper ends of the links 70 and perpendicular to the longitudinal axis of the control handle 56. The control handle 56 is also supported by a shaft 76 extending through the cap 66. A first generally vertically extending link 78 is pivotally connected at its lower end by a pin to the upper end of the central spool 62 of one of the linear variable displacement transducers 60, and the upper end of the link 78 is pivotally connected to the cap 66 by a pin 87 (FIG. 4) in spaced relation from the horizontal pivotal axis of the cap 66 and such that up and down movement of the handle 56, which causes consequent pivotal movement of the metal cap 66, results in vertical movement of the push rod or link 78 and consequent vertical movement of the control spool 62 of the linear voltage displacement transducer 60. Means are also provided for resiliently biasing the cap 66 and the handle 56 toward a neutral position. In one preferred form of the invention this can comprise a second push rod 78 connected by a pin 89 to the cap 66. The lower end of the second push rod 78 is connected to a compression spring assembly 79 such that pivotal movement of the cap 66 about the pivot axis of pin 71 is resisted by that compression spring assembly 79.

Means are further provided for causing vertical reciprocal movement of the central spool 62 of a third linear variable displacement transducer 60 in response to rotation of the control handle 56 about its longitudinal axis. In the illustrated arrangement the control handle 56 is fixed to the shaft 76, and the shaft 76 is supported in bores 91 and 93 in the metal cap 66 such that the shaft 76 is rotatable about its longitudinal axis. A lever 80 (FIG. 4) is fixed to the shaft 76 and includes opposite ends extending generally horizontally and radially outwardly from the shaft 76. A linkage or push rod 82 is pivotally connected at its lower end to the central spool 62 of a third linear variable displacement transducer 60, and the upper end of the linkage 82 is pivotally connected to one of the opposite ends of the lever 80 extending outwardly from the shaft 76 by a ball joint 91. Rotation of the control handle 56 about its longitudinal axis and consequent rotation of the shaft 76 about its longitudinal axis will cause vertical movement of the free end of lever arm 80 and vertical reciprocal movement of the linkage 82 and the central spool 62 of the linear variable displacement transducer 60. The other of the opposite ends of the lever 80 is connected through a ball joint 91 by a second push rod 82 to a third compression spring assembly 79 which functions to bias the control handle toward a neutral position.

Means are further provided for disabling the control means and preventing operation of the control means in the event that the operator releases his grip on the control handle 56. In the illustrated construction, this means for disabling the control means includes an electrical switch 86 electrically connected to the electrical control apparatus to be described and operable to prevent operation of the control means unless a switch contact 88 of the switch 86 is depressed.

The control handle 56 also includes means for selectively engaging the switch contact 88 when the operator grasps the control handle 56. The control handle 56 includes a pivotable lever 104 housed in a cavity 106 in the control handle, and the lever 104 is engageable with the switch contact 88. When the operator grips the handle 56 and compresses the pivotable lever 104, the pivotable lever engages the switch contract 88 closing the switch 86 and enabling the control device.

Means are also provided for transmitting the electrical signal produced by the three linear variable displacement transducers 60 to the electro-hydraulic proportional valves 40 such that selective linear movement of the control spools 62 of the linear variable displacement transducers 60, as caused by movement of the control handle 56, actuates selected ones of the electro-hydraulic proportional valves 40. In the illustrated construction this means for transmitting the electrical signals produced by the linear variable displacement transducers 60 includes a single fiber optic cable 110 (FIG. 5) extending along the length of the booms 22 and 26 and having one end located adjacent the control apparatus at the bucket 12, and an opposite end communicating with the hydraulic control valves 40. The fiber optic cable 110 is conventional and is sufficiently flexible that it can bend freely to accommodate pivotal movement of the booms 22 and 26 with respect to one another.

Means are also provided for translating the electrical signals produced by the linear variable displacement transducers 60 to optic signals which can be transmitted by the fiber optic cable 110. In the illustrated arrangement this means for translating can comprise a conventional fiber optic transmitter 112 of the type manufactured by PQ Controls Inc., Bristol, Conn. The fiber optic transmitter 112 is operably connected by wires 113 to the linear variable displacement transducers 60 so as to receive electrical signals from the linear variable displacement transducers 60. The fiber optic transmitter 112 converts these electrical signals to an optic signal which can be conveyed by the optic fiber 110 extending along the booms 22 and 26.

Means also provided for translating the optic signal transmitted by the fiber optic cable 110 to an electrical signal which can be transmitted to the electro-hydraulic proportional control valves 40 to cause operation of these valves. In a preferred form of the invention this means for translating comprises a conventional fiber optic receiver 114 also of the type manufactured by PQ Controls Inc.

While the electro-hydraulic proportional control valves 40 could be supported by the support structure 20 or boom 22 for rotation with the boom, in a preferred form of the invention, the control valves 40, the hydraulic fluid pump 41 and all other controls are supported by the truck frame. This produces a less complicated hydraulic arrangement and facilitates a less expensive hydraulic assembly construction, while also allowing the Provision of other accessories to be connected below the point of rotation without the provision of a Plurality of sets of brushes in the swivel assembly.

Figure 6:
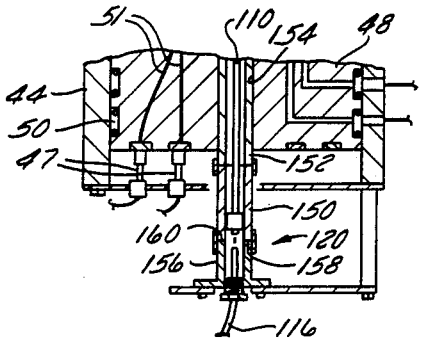
FIG. 6 an enlarged partial cross section elevation view of apparatus illustrated in FIG. 5 and further showing a fiber optic swivel.

Means are also provided for effectively connecting the fiber optic cable 110 to the fiber optic receiver 114 supported by the truck frame. In the specific arrangement illustrated in FIGS. 5 and 6, this means includes a fiber optic swivel assembly 120 located centrally with respect to the axis of rotation of the aerial tower. A second fiber optic cable 116 extends from the swivel 120 to the fiber optic receiver 114. The swivel 120 functions to join one end of the optic fiber 110 to the optic fiber 116 such that they are positioned in end-to-end closely adjacent relation and such that an optic signal can be conveyed from one fiber to the other while permitting rotation of fiber 110. While the fiber optic swivel 120 could be constructed in other ways, FIG. 6 illustrates a fiber optic swivel device 120 of the type commercially available from Deutsch Industrial Products Division, Hemet, Calif. A fiber optic swivel 120 of this type includes a first coupling member 150 which in the illustrated arrangement is fixed to the lower end of a downwardly extending tube 152 housing the fiber optic cable 110. The downwardly extending tube 152 is housed in a central longitudinally extending bore 154 in the rotatable spool 48 and is fixed thereto to rotate with the rotatable spool 48. The first coupling member 150 houses the lower end of the fiber optic cable 110 and fixes it in position. An upper end of the optic cable 116 is similarly supported by a second coupling member 156 fixed to the truck frame. The first and second coupling members 150 and 156 include opposed mating surfaces 158 and 160, respectively, and the coupling members 150 and 156 are supported for rotation with respect to one another around a common vertical axis. The coupling members 150 and 156 function to hold the opposed ends of the optic fibers 110 and 116 together in closely adjacent linearly aligned relation and such that the ends of the optic fibers 110 and 116 will have a common longitudinal axis.

Figure 7:
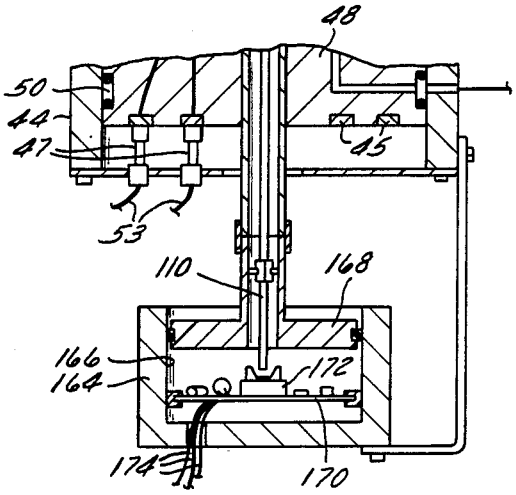
FIG. 7 is an enlarged view of apparatus illustrated in FIG. 6 and showing an alternative embodiment of a fiber optic swivel arrangement.

FIG. 7 illustrates another preferred embodiment of a swivel means for supporting the lower end of fiber optic cable 110 and for translating the optic signal transmitted by the fiber optic cable 110 to an electrical signal. The truck frame supports a cylinder 164 having a central bore 166 and a coupling member 168 is housed in the central bore 166 so as to be freely rotatable about the longitudinal axis of the central bore 166. The coupling member 168 supports the lower end of the fiber optic cable 110 in alignment with the central longitudinal axis of the central bore 166. The central bore 166 also houses a circuit board 170 supporting a centrally located photo transistor 172. The circuit board 170 and photo transistor 172 are components included in a conventional fiber optic preamplifier of the type included in the fiber optic receiver 114 shown in FIG. 5. In such a conventional fiber optic preamplifier, the end of a fiber optic cable, such as cable 116 is fixed in opposed relation to the photo transistor. Using the embodiment illustrated in FIG. 7, the circuit board 170 and photo transistor 172 of the fiber optic preamplifier are mounted in the central bore 166. The circuit board 170 can be connected to the remainder of the components of the fiber optic receiver by wires 174.

In the illustrated construction means are also provided for permitting the operator in the bucket 12 to control a number of the functional operations of the truck, such as the truck engine ignition, truck starter, a hydraulic tool control circuit on-off switch, an emergency hydraulic fluid pump on-off switch, a throttle control switch and the like. This means includes a control panel 130 forming a portion of the housing of the fiber optic transmitter 112. While the control panel 130 could include a number of different switch arrangements for controlling a variety of functions of the type described, in the illustrated construction the control panel of the fiber optic transmitter 112 includes a switch 132 for controlling the engine ignition. The electrical signal produced by switch 132 is converted by the fiber optic transmitter 112 to an optic signal conveyed by the optic fiber 110 to the optic receiver 114. The optic receiver 114 is electrically connected to the truck ignition system such that an optic signal received by the control device 114 can be converted to an electrical signal which will, in turn, operate the truck ignition or other electrically controlled function.

Another feature of the present invention is the provision of means for providing electrical voice communication between the operator in the bucket 12 and 2-way radio of the truck. In the illustrated arrangement the fiber optic transmitter control panel further includes a microphone 140 for use by the operator. In the illustrated arrangement, the bucket 12 also supports a battery 139 electrically connected to the fiber optic transmitter 112 to provide electrical power to the fiber optic transmitter 112 and to the linear variable displacement transducers 60.

Figure 2:
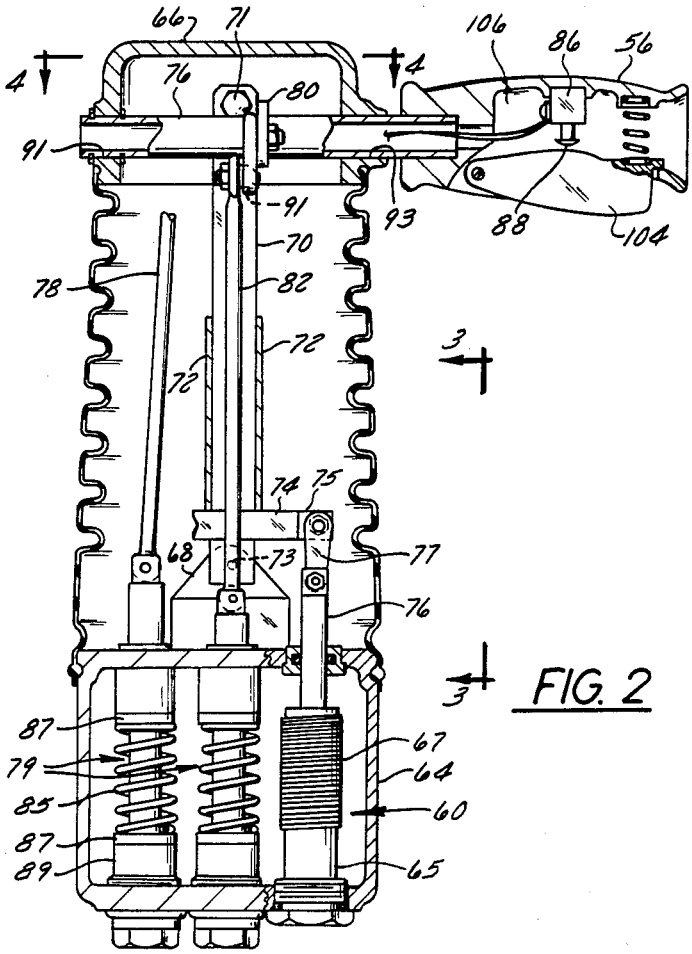
FIG. 2 is an enlarged cross section elevation view of a control apparatus embodied in the aerial lift illustrated in FIG. 1.
Figure 9:
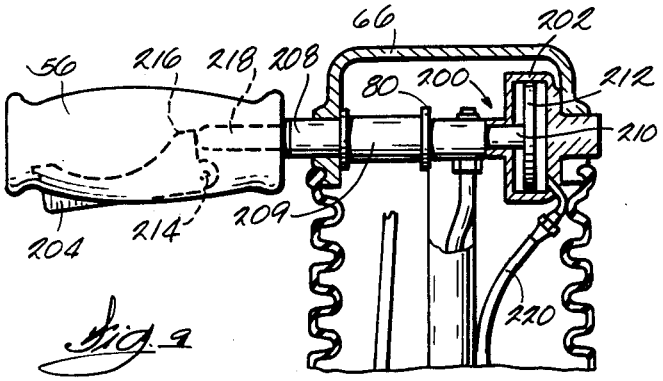
FIG. 9 is a view like that of FIG. 2 and showing an alternative embodiment of the invention and including an air pressure operated control valve interlock.
Figure 10:
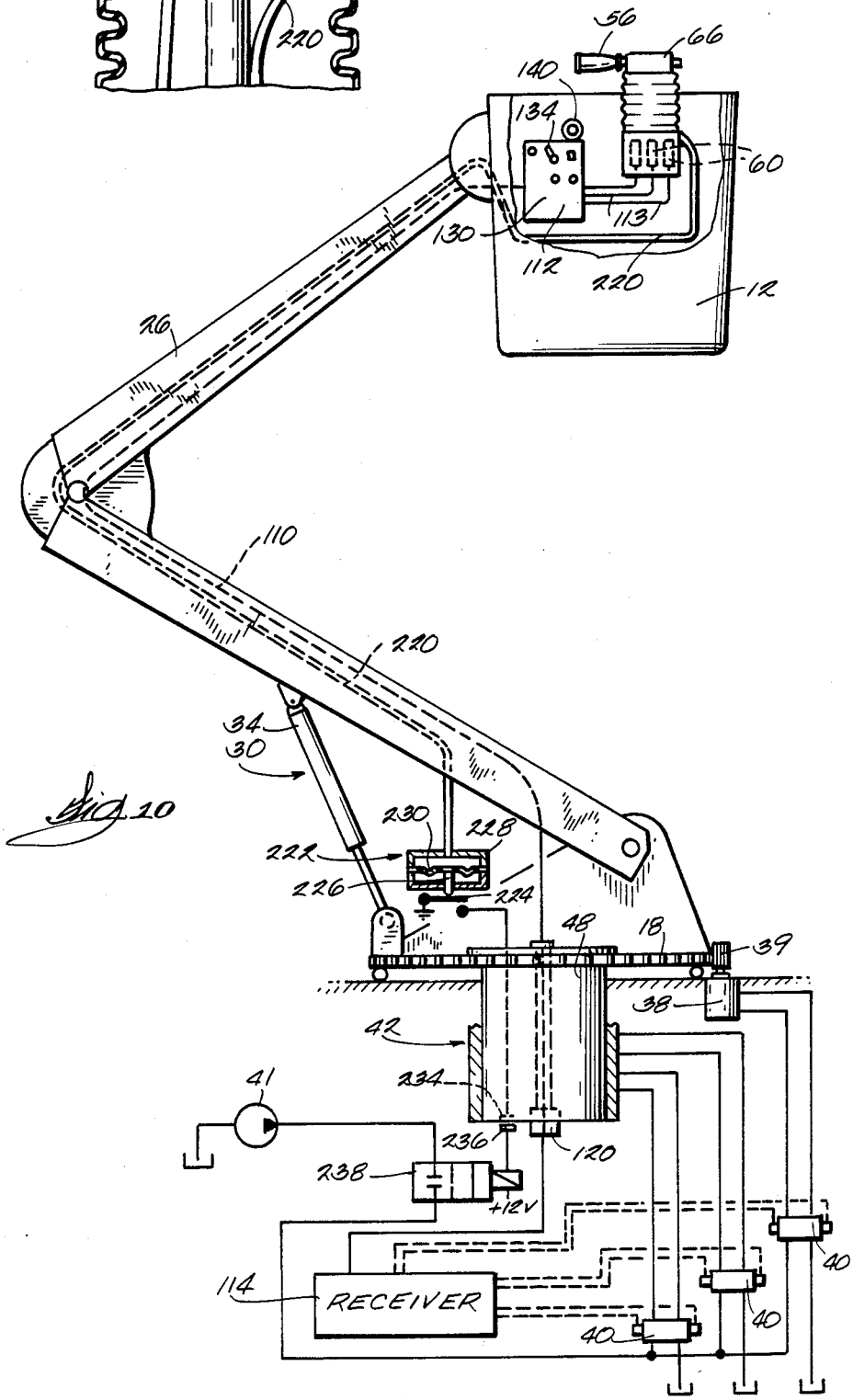
FIG. 10 is a view of an alternative embodiment of the apparatus shown in FIG. 5 and showing the air pressure operated control valve interlock system shown in FIG. 9.

Illustrated in FIGS. 9 and 10 is an alternative embodiment of the invention wherein the electrical interlock switch 86 shown in FIG. 2 and for use in controlling actuation of the control valves 40 is replaced by an air pressure operated interlock assembly 200 including an air pressure cylinder 202 operated by a deadman lever 204 of the control handle 56.

More particularly, the air pressure operated interlock assembly 200 includes an operator manipulated handle 56 mounted on a tubular shaft 208, the tubular shaft 208 extending into the end of the cap 66. A collar 209 surrounds a portion of the tubular shaft 208 and is fixed to the tubular shaft. The collar 209 includes one end abutting an inside surface of the cap 66 and an opposite end engaging the cross member 80. Slidably housed in the tubular shaft 208 is an elongated plunger 210. The plunger is supported in the tubular shaft 208 for limited movement in the direction of the longitudinal axis of the tubular shaft. The plunger 210 includes an end extending into the pneumatic cylinder 202, and a piston 212 is supported on the end of the plunger 210. The deadman lever 204 is pivotally supported in the central cavity of the handle 56 by a pin 214 and includes a lever portion 216 adapted to engage the end 218 of the plunger 210 when the operator grips the handle 56 and causes upward movement of the deadman lever 204 into the cavity in the handle. The plunger 210 in turn causes movement of the piston 212 and compression of air in the cylinder 202. A tube 220 communicates with the cylinder 202, and the tube 220 extends along the length of the articulated boom to the base of the boom.

Means are also provided for selectively enabling the hydraulic valves 40 in response to movement of the deadman lever 204 into the cavity of the control handle 56 and the consequent increase in pressure in the pneumatic cylinder 202. FIG. 10 illustrates the flexible pneumatic tube 220 extending along the length of the articulated boom and terminating at a switch assembly 222 mounted at the base of the boom. The switch assembly 222 includes a normally open switch 224 adapted to be engaged by a piston or plunger 226 extending from a cylinder 228. The plunger 226 is supported by a diaphragm 230 in the cylinder 228, and the lower end of the flexible pneumatic tube 220 is connected to the cylinder 228, such that increased pressure in the cylinder 202 will be transmitted to the cylinder 228 and will cause extension of the plunger 226, and closing of the contacts of the switch 224. The switch 224 is connected through wiper contacts 234 and 236 at the base of the swivel 42 to a solenoid operated valve 238. The solenoid operated valve 238 functions to control supply of hydraulic fluid from the hydraulic fluid pump 41 to the valves 40. When the switch 224 is open, the solenoid operated valve 238 is deenergized thereby interrupting supply of hydraulic fluid from the pump 41 to the valves 40 and causing the hydraulic boom to be locked in place. When the operator grips handle 56 and deadman lever 204 to thereby close the switch 224, the solenoid operated valve 238 is energized to provide hydraulic fluid flow to the valves 40. The valves 40 can then provide for controlled movement of the bucket.

The pneumatic control arrangement operated by the deadman lever 204 thus provides a means for controlling operation of the valves 40 which is independent of the electrical and fiber optic control system. One of the advantages of the pneumatic interlock is that in the event of failure of the electrical control apparatus of the control handle or in the transmission of optic signals, since the pneumatic interlock system is independent of the electrical system, and the operator can lock the boom in place by merely releasing the deadman lever to thereby disable the control valves. Another advantage of this arrangement is that operability of the pneumatic control system is tested by the operator each time he grips the control handle to cause movement of the bucket.

Figure 11:
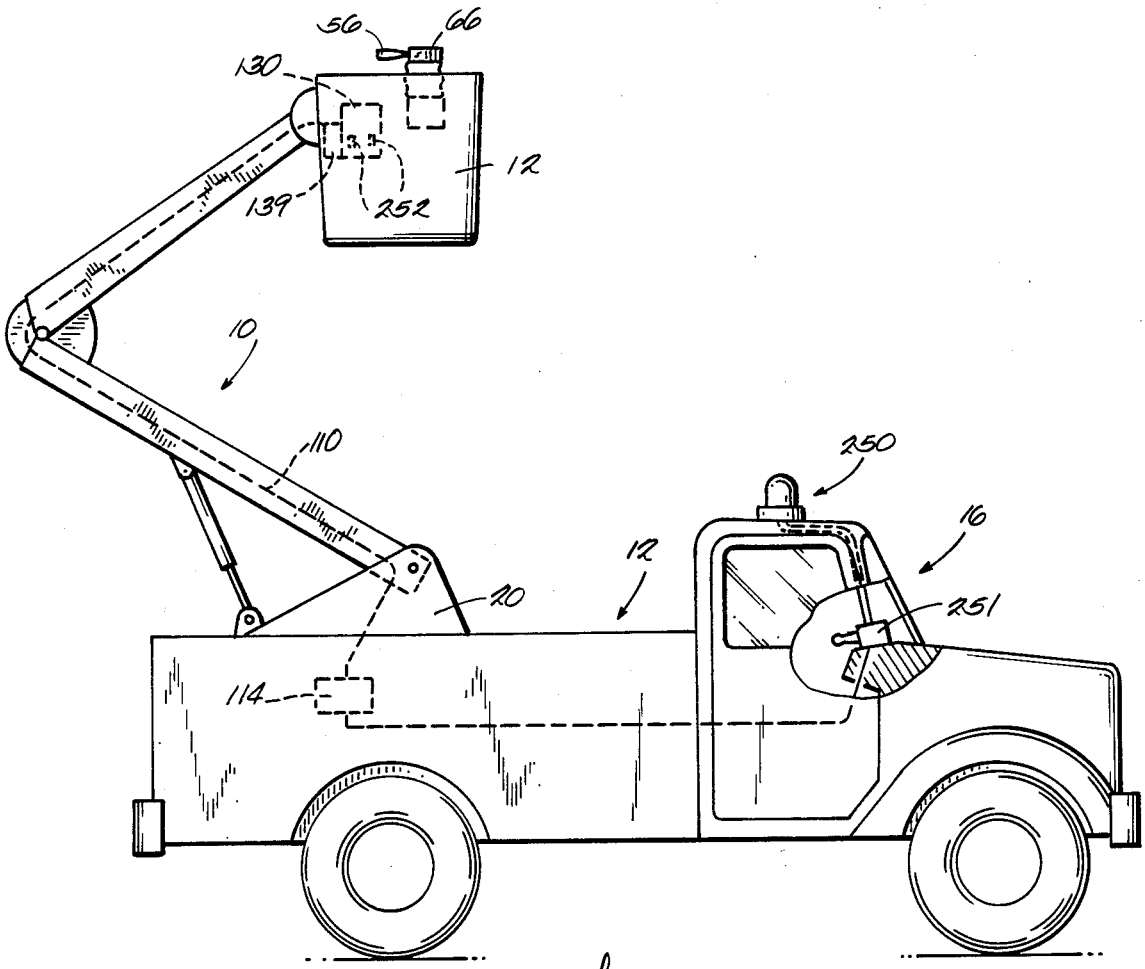
FIG. 11 is a perspective view of a truck mounted aerial lift embodying the invention and including a remote controlled spotlight.

Illustrated in FIG. 11 is another embodiment of the control apparatus and including remote means for controlling operation of a spotlight 250 mounted on the truck 16 supporting the aerial lift 10. In a preferred form of the invention, the spotlight 250 can be a VISIBEAM searchlight manufactured by Federal Signal Corporation, University Park, Illinois. The VISIBEAM searchlight includes a control module 251 which is adapted to be mounted in the truck cab and which provides a means for accurately controlling the position of the beam of the spotlight 250. The control module 251 includes a first switch for causing rotation of the light about a vertical axis such that the direction of the beam can be moved left and right and a second switch for controlling elevation of the beam.

Figure 12:
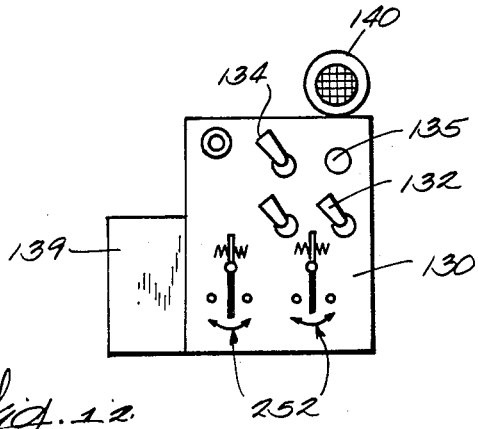
FIG. 12 is an enlarged view of a control panel supported by the bucket of the aerial lift shown in FIG. 11.

Means are also provided in the embodiment illustrated in FIG. 11 for permitting control of the spotlight 250 by an operator in the bucket 12. In the illustrated arrangement, the control panel 130 supported by the bucket 12 includes a pair of momentary rocker-type center-off switches 252. These switches 252 are operably connected through the fiber optic control system and the receiver 114 to the control module 251 in the truck cab. One of the switches 252 provides for up and down movement of the spotlight beam, while the second switch is intended to provide a means for causing rotation of the light about its vertical axis to thereby control movement of the light beam left and right. The apparatus illustrated in FIGS. 11 and 12 thus provides a means for permitting an operator in the bucket 12 to control the direction of the spotlight 250 used to illuminate the work area.

Various features of the invention are set forth in the following claims.

I claim:

1. An aerial lift comprising a frame, a support structure supported by the frame for pivotal movement about a vertical axis, an elongated boom having opposite ends, means for pivotally joining one of the opposite ends of the elongated boom to the support structure, a platform for use in supporting a workman supported by the other of the opposite ends of the elongated boom, a hydraulic fluid motor for causing selective pivotal movement of the support structure around said vertical axis, a hydrualic cylinder connected to the support structure and to the elongated boom for causing selective pivotal movement of the elongated boom with respect to the support structure, and means for controlling operation of the hydraulic fluid motor and the hydraulic cylinder, said means for controlling operation including valve means supported by said frame, a manually operable control means supported by the platform and adapted to be manipulated by the operator to provide for controlled movement of the platform, the manually operable control means including a control handle supported for controlled movement, means for converting movement of the control handle to an optic signal, and an optic fiber means for operably connecting the manually operable control means to the valve means, the optic fiber means including an optic fiber supported to extend along the length of the elongated boom, the optic fiber having opposite ends, one of the opposite ends of the optic fiber receiving an optic signal from the means for converting movement of the control handle to an optic signal, and the other of the ends of the optic fiber including a longitudinal axis colinear with said vertical axis, and swivel means for supporting the end of said optic fiber such that its longitudinal axis is colinear with said vertical axis and such that said other end of said optic fiber is supported for rotation about its longitudinal axis with said support strucutre and means for receiving an optic signal from said other end of said optic fiber and for converting said optic signal to an electrical signal for controlling said valve means, said means for receiving an optic signal from said other end of said optic fiber being supported by the frame below the point of pivotal movement of the support structure about the vertical axis.

2. An aerial lift as set forth in claim 1 wherein said manually operable control means includes means for supporting the control handle for movement in three directions.

3. An aerial lift as set forth in claim 3 wherein the control handle includes a longitudinal axis and wherein the means for supporting the handle includes means for supporting the control handle for rotation around the control handle longitudinal axis, means for supporting the control handle for pivotal movement about a pivot axis transverse to the control handle longitudinal axis and extending through the control handle, and means for supporting the control handle for reciprocal movement generally in the direction of the control handle longitudinal axis.

4. An aerial lift as set forth in claim 1 wherein the manually operable control means includes means for producing a first electrical signal when the control handle is rotated about the control handle longitudinal axis, means for producing a second electrical signal when the control handle is pivoted about a pivot axis transverse to the control handle longitudinal axis, and means for producing a third electrical signal when the control handle is moved in the direction of the control handle longitudinal axis.

5. An aerial lift as set forth in claim 1 wherein the manually operable control means includes means for producing a first electrical signal when the control handle is moved in a first control direction, means for producing a second electrical signal when the control handle is moved in a second control direction, and means for producing a third electrical signal when the control handle is moved in a third control direction.

6. An aerial lift as set forth in claim 5 wherein the means for producing the first electrical signal includes a first linearly moveable member and means for producing an electrical signal proportionate to the length of movement of the linearly moveable member, wherein the means for producing the second electrical signal includes a second linearly moveable member and means for producing an electrical signal proportionate to the length of movement of the second linearly moveable member, and wherein the means for producing the third electrical signal includes a third linearly moveable member and means for producing an electrical signal proportionate to the length of movement of the third linearly moveable member.

7. An aerial lift as set forth in claim 1 wherein the optic fiber means includes means for receiving the electrical signals from the means for producing electrical signals and for converting the electrical signals to signals which can be conveyed by an optic fiber, and means located adjacent the lower end of the articulated boom for converting the signal conveyed by the optic fiber to an electrical signal.

8. An aerial lift as set forth in claim 7 wherein the valve means are electrically responsive and wherein the means for converting the signal conveyed by the optic fiber to an electrical signal is operably connected to the electrically responsive valve such that electrical signals produced by the means for converting the signal conveyed by the optic fiber are conveyed to the electrically responsive valve to cause operation of the electrically responsive valve.

9. An aerial lift as set forth in claim 1 wherein said swivel means supports and further including said means for receiving an optic signal and said opposite end of the optic fiber such that an optic signal conveyed by said optic fiber will be transmitted to the means for receiving and such that said optic fiber is rotatable with respect to said means for receiving.

10. An aerial lift as set forth in claim 1 and further including a radio supported by the frame, a microphone supported by the platform, and means for transmitting a signal from the microphone to the radio, the means for transmitting a signal including a means for converting an electrical signal from said microphone to an optic signal to be transmitted by said optic fiber along the length of the elongated boom and a means at one of the opposite ends of the boom for converting the optic signal to an electrical signal to be transmitted to the radio.

11. An aerial lift as set forth in claim 1 and further including a light means supported by the vehicle, said light means including means for producing a light beam and means for controlling the direction of the light beam, a light control means supported by the platform, said light control means including means for producing an optic signal to be transmitted by the optic fiber, and wherein said means for receiving an optic signal includes means for transmitting an electrical signal to the light means.

12. An aerial lift as set forth in claim 1 and further including interlock means for selectively interrupting supply of hydraullic fluid to said hydraulic cylinder means, said interlock means including an air pressure chamber, means supported by said control handle and for changing the air pressure in said air pressure chamber when an operator supported by the platform grips the control handle, an air pressure conduit extending generally along the length of said extensible boom, and means conencted to said air pressure conduit for selectively interrupting supply of hydraulic fluid to said hydraulic cylinder means in response to a change in the air pressure in said conduit.

13. An aerial lift as set forth in claim 12 wherein said interlock means includes a solenoid operated valve for controlling supply of hyraulic fluid from the pump to said hydrulic cylinder means, and an air pressure operated switch connected to the air pressure conduit and for controlling operation of the solenoid.

14. An aerial lift as set forth in claim 12 wherein said air pressure chamber includes a cylinder and wherein said means supported by said control handle and for changing the air pressure in said air pressure chamber includes a piston housed in said cylinder, and means for causing movement of said piston in said cylinder when the operator grips the control handle.

15. A control system for use with an aerial lift and for use in controlling movement of a platform supported by the aerial lift, the aerial lift including a frame, a support structure supported by the frame for pivotal movement about a vertical axis, an elongated boom having opposite ends, means for pivotally joining one of the opposite ends of the elongated boom to the support structure, the other of the opposite ends of the elongated boom supporting the platform, a hydraulic fluid motor for causing selective pivotal movement of the support structure around said vertical axis, and a hydraulic cylinder connected to the support structure and to the elongated boom for causing selective pivotal movement of the elongaed boom with respect to the support structure, the control system comprising:

means for controlling operation of the hydraulic fluid motor and the hydraullic cylinder, said means for controlling operation including valve means adapted to be supported by the frame, a manually operable control means adapted to be supported by the platform and adapted to be manipulated by the operator to provide for controlled movement of the platform, the manually operable control means including a control handle supported for controlled movement by the operator, means for converting movement of said control handle to an optic signal, and an optical fiber means operably connecting the manually operable control means to the valve means, said optic fiber means including an optic fiber adapted to extend along the length of the elongated boom, the optic fiber having opposite ends, one of the opposite ends of the optic fiber receiving an optic signal from the means for converting, and swivel means for supporting the end of the optic fiber such that its longitudinal axis is colinear with the vertical axis of pivotal movement of the support structure and such that the other end of the optic fiber has a longitudinal axis colinear with the vertical axis and is supported by the support structure for rotation about the vertical axis, and means for receiving an optic signal from the other end of the optic fiber and for converting the optic signal to an electrical signal, said means for receiving an optic signal from said other end of the optic fiber supported by the frame below the point of pivotal movement of the support structure.

16. A control system as set forth in claim 15 wherein said manually operable control means includes a frame, a control handle adapted to be manipulated by the operator, the control handle including a longitudinal axis, and means for supporting the handle including mean for supporting the handle for rotation around the longitudinal axis, means for supporting the handle for pivotal movement about a pivot axis transverse to the longitudinal axis and extending through the handle, and means for supporting the handle for reciprocal movement generally in the direction of the longitudinal axis.

17. A control system as set forth in claim 15 wherein the manually operable control includes means for producing a first electrical signal when the control handle is rotated about its longitudinal axis, means for producing a second electrical signal when the control handle is pivoted about a pivot axis transverse to the longitudinal axis, and means for producing a third electrical signal when the control handle is moved in the direction of its longitudinal axis.

18. A control system as set forth in claim 15 wherein the manually operable control includes means for producing a first electrical signal when the control handle is moved in a first control direction, means for producing a second electrical signal when the control handle is moved in a second control direction, and means for producing a third electrical signal when the control handle is moved in a third control direction.

19. A control system as set forth in claim 18 wherein the means for producing the first electrical signal includes a first linearly moveable member and means for producing an electrical signal proportionate to the length of movement of the linearly moveable member, wherein the means for producing the second electrical signal includes a second linearly moveable member and means for producing an electrical signal proportionate to the length of movement of the second linearly moveable member, and wherein the means for producing the third electrical signal includes a third linearly moveable member and means for producing an electrical signal proportionate to the length of movement of the third linearly moveable member.

20. A control system as set forth in claim 18 wherein the optic fiber means includes means for receiving the electrical signals from the means for producing electrical signals and for converting the electrical signals to signals which can be conveyed by an optic fiber, and means located adjacent the lower end of the articulated boom for converting the signal conveyed by the optic fiber to an electrical signal.

21. A control system as set forth in claim 20 wherein the valve means are electrically responsive and wherein the means for converting the signal conveyed by the optic fiber to an electrical signal is operably connected to the electrically responsive valve means such that electrical signals produced by the means for converting the signal conveyed by the optic fiber are conveyed to the electrically responsive valve means to cause operation of the electrically responsive valve means.

22. A control system as set forth in claim 15 wherein swivel means supports said means for receiving an optic signal and said opposite end of the optic fiber such that an optic signal conveyed by said first optic fiber will be transmitted to said means for receiving and such that said optic fiber is rotatable with respect to said means for receiving.

23. A combination comprising: a frame, a support structure supported by the frame for pivotal movement about a vertical axis an elongated boom supported by the support structure for movement with the support structure, an optic fiber extending along said elongated boom and for transmitting an optic signal and said optic fiber having an end for emitting the optic signal, said end of said optic fiber having a central longitudinal axis, means for receiving the optic signal from the end of the optic fiber and for converting the optic signal to an electrical signal, the means for receiving the optic signal including a light sensitive means for converting an optic signal to an electrical signal, said means for receiving the optic signal from the end of the optic fiber being supported by the frame below the point of pivotal movement of the support structure about the vertical axis, swivel means for supporting the end of the optic fiber such that the end of the optic fiber is closely adjacent the light sensitive means for converting an optic signal to an electrical signal whereby the optic signal emitted by the optic fiber can be transmitted to the light sensitive means for conveting an optic signal to an electrical signal, and the swivel means supporting the end of the optic fiber such that the longitudinal axis of the optic fiber is colinear with the vertical axis and supporting the end of the optic fiber for rotation about the central longitudinal axis with respect to the light sensitive means for converting an optic signal to an electrical signal such that the end of the optic fiber is aligned with the light sensitive means for converting an optic signal to an electrical signal during rotation of the optic fiber.

24. A combination as set forth in claim 23 wherein the light sensitive means for converting an optic signal to an electrical signal includes a phototransistor having an optic signal receiving surface and wherein the end of the optic fiber is positioned in opposed closely adjacent relation to a central portion of the optic signal receiving surface.

25. A combination as set forth in claim 23 wherein the swivel means includes a body supported by the frame and a central rotatable portion rotatable with respect to the body about the central longitudinal axis, the central rotatable portion including a central bore housing a portion of the optic fiber.

26. A swivel means for use in an apparatus including a support structure supported for pivotal movement about an axis of rotation and an elongated boom supported by the support structure, and the swivel means being for use in suppporting an end of an optic fiber for rotation about the axis of rotation such that the optic fiber can be supported by the support structure for pivotal movement about the axis of rotation, the end of the optic fiber having a central longitudinal axis colinear with said axis of rotation, and the swivel means supporting the optic fiber for rotation about the central longitudinal axis and for supporting the end of the optic fiber in closely adjacent relation to a means for receiving an optic signal, the means for receiving the optic signal including a light sensitive means for converting an optic signal to an electrical signal, and whereby the end of the optic fiber can transmit an optic signal to the means for receiving an optic signal, said swivel means comprising, a body including a central cylindrical bore having a central longitudinal axis, the body including means for supporting the light sensitive means and a rotatable swivel portion housed in the central bore of the body and supported for rotation in the bore about the central longitudinal axis, the rotatable swivel portion including a bore housing the end of the optic fiber and supporting the optic fiber for rotation about the central longitudinal axis with respect to the body and with respect to the means for receiving the optic signal, and the rotatable swivel portion supporting the end of the optic fiber in closely spaced adjcent reltion to the light sensitive means whereby a light emitted by the end of the optic fiber will be received by the light sensitive means.

27. A combination comprising a frame, a structure supported by the frame, swivel means for supporting the structure for rotation about a central longitudinal axis with respect to the frame, an elongated boom supported by the structure for rotation with the structure about the central longitudinal axis, an optic fiber supported by the elongated boom and extending along the length of the boom, the optic fiber including opposite ends, one of the opposite ends of said optic fiber being housed in the swivel means and having a longitudinal axis colinera with the central longitudinal axis of rotation of the swivel means, means fixedly supported by the frame for receiving an optic signal from the end of the optic fiber and for converting that optic signal to an electrical signal, said means fixedly supported by the frame for receiving an optic signal being supported below the point of rotation of the structure about the central longitudinal axis, and means for supporting the end of the optic fiber for rotation with the support structure about said longitudinal axis and the central longitudinal axis of the swivel means in response to rotation of the structure with respect to the frame, said means for supporting the end of the optic fiber supporting the end of the optic fiber in closely spaced adjacent relation to the means for receiving the optic signal and for rotation about the longitudinal axis with respect to the means for receiving an optic signal.

28. A combination as set forth in claim 27 wherein the swivel means includes a body portion having a central bore, said body portion being supported by said frame, and a central rotatable portion housed in said central bore and rotatable in said central bore about the central longitudinal axis of said central bore, said central rotatable portion including a central longitudinally extending bore housing the end of the optic fiber.

29. A combination as set forth in claim 27 wherein the means for receiving the optic signal from the end of the optic fiber comprises a phototransistor including an optic signal receiving surface, the phototransistor being supported by the frame such that the optic signal receiving surface is positioned in closely adjacent and opposed relation to the end of the optic fiber whereby the phototransistor optic signal receiving surface will receive an optic signal from the end of optic fiber during rotation of the optic fiber with respect to the frame.

30. A combination as set forth in claim 27 wherein said swivel means includes means for providing a hydraulic fluid connection between hydraulic fluid conduits supported by said frame and hydraulic fluid conduits supported by said structure.

* * * * *